US011183789B2

(12) United States Patent
Li

(10) Patent No.: US 11,183,789 B2
(45) Date of Patent: Nov. 23, 2021

(54) POWER INTERFACE, MOBILE TERMINAL AND POWER ADAPTER

(71) Applicant: GUANGDONG OPPO MOBILE TELECOMMUNICATIONS CORP., LTD., Guangdong (CN)

(72) Inventor: Feifei Li, Dongguan (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 404 days.

(21) Appl. No.: 16/317,869

(22) PCT Filed: Apr. 18, 2017

(86) PCT No.: PCT/CN2017/080957
§ 371 (c)(1),
(2) Date: Jan. 15, 2019

(87) PCT Pub. No.: WO2018/018946
PCT Pub. Date: Feb. 1, 2018

(65) Prior Publication Data

US 2021/0194168 A1 Jun. 24, 2021

(30) Foreign Application Priority Data

Jul. 27, 2016 (CN) ..... 201620803021.1

(51) Int. Cl.
*H01R 24/00* (2011.01)
*H01R 13/26* (2006.01)
*H01R 13/405* (2006.01)

(52) U.S. Cl.
CPC ..... *H01R 13/26* (2013.01); *H01R 13/405* (2013.01); *H01R 2201/06* (2013.01)

(58) Field of Classification Search
CPC ... H01R 13/26; H01R 13/405; H01R 2201/06
(Continued)

(56) References Cited

U.S. PATENT DOCUMENTS 5,332,979 A * 7/1994 Roskewitsch ..... H03F 1/523 331/116 R
5,566,340 A * 10/1996 Stewart ..... G06F 1/3203 713/320
(Continued)

FOREIGN PATENT DOCUMENTS

CN 203166148 U 8/2013
CN 203553401 U 4/2014
(Continued)

OTHER PUBLICATIONS

Supplementary European Search Report in the European application No. 17833252.4, dated May 31, 2019.
(Continued)

*Primary Examiner* — Abdullah A Riyami
*Assistant Examiner* — Vladimir Imas

(57) ABSTRACT

A power interface (100), a mobile terminal and a power adapter. The power interface (100) comprises a body portion (110), a data pin (120), a power pin (130) and an insulating spacer layer (139). The body portion (110) is adapted to connect a circuit board, a plurality of data pins (120) are spaced and connected to the body portion (110). A plurality of power pins (130) may be spaced and connected to the body portion (110). The power pins (130) and the data pins (120) are arranged at intervals, at least one of the plurality of power pins (130) comprises a widened section (132), the cross sectional area of the widened section (132) being greater than the cross sectional area of the data pins (120) so as to increase the current load amount of the power pins (130).

20 Claims, 10 Drawing Sheets

(58) Field of Classification Search
USPC ..... 439/676
See application file for complete search history.

(56) References Cited

U.S. PATENT DOCUMENTS

| | | | | |
|---|---|---|---|---|
| 5,987,613 | A * | 11/1999 | Busch | G06F 1/1616 713/300 |
| 6,558,201 | B1 * | 5/2003 | Begley | H01R 31/06 439/638 |
| 8,753,138 | B2 * | 6/2014 | Foster, Sr. | H01R 12/7088 439/326 |
| 9,501,118 | B2 * | 11/2016 | Hijazi | G06F 1/26 |
| 9,791,906 | B2 * | 10/2017 | Hijazi | G06F 1/1632 |
| 9,891,680 | B2 * | 2/2018 | Hijazi | G06F 1/26 |
| 10,281,967 | B2 * | 5/2019 | Hijazi | G06F 1/266 |
| 10,581,188 | B2 * | 3/2020 | Gu | H01R 13/405 |
| 10,622,750 | B2 * | 4/2020 | Li | H01R 13/26 |
| 10,630,013 | B2 * | 4/2020 | Gu | H01R 13/405 |
| 10,630,014 | B2 * | 4/2020 | Gu | H01R 12/57 |
| 10,673,163 | B2 * | 6/2020 | Li | H01R 24/60 |
| 10,686,275 | B2 * | 6/2020 | Li | H01R 13/5045 |
| 10,734,747 | B2 * | 8/2020 | Li | H01R 24/60 |
| 10,897,111 | B2 * | 1/2021 | Li | H01R 13/02 |
| 2008/0261448 | A1 * | 10/2008 | Yi | H01R 24/62 439/607.01 |
| 2010/0068939 | A1 * | 3/2010 | Xu | H01R 24/60 439/651 |
| 2012/0214323 | A1 * | 8/2012 | Gore | H04N 9/3173 439/212 |
| 2013/0117470 | A1 * | 5/2013 | Terlizzi | G01R 31/08 710/3 |
| 2013/0183864 | A1 * | 7/2013 | Hopkins | H01R 13/46 439/660 |
| 2013/0244491 | A1 * | 9/2013 | Sarwar | G06F 13/4068 439/655 |
| 2014/0141647 | A1 | 5/2014 | Do | |
| 2015/0004845 | A1 * | 1/2015 | Barrefelt | H01R 13/504 439/626 |
| 2015/0380917 | A1 * | 12/2015 | Ross | H01R 13/70 361/679.02 |
| 2016/0372876 | A1 * | 12/2016 | Zhang | H01R 24/64 |
| 2017/0201052 | A1 * | 7/2017 | Peng | H01R 24/60 |
| 2017/0237214 | A1 * | 8/2017 | Zhong | H04N 5/63 439/639 |
| 2017/0331236 | A1 * | 11/2017 | Zhang | H01R 24/64 |
| 2018/0069357 | A1 | 3/2018 | Zhang et al. | |
| 2019/0123474 | A1 * | 4/2019 | Gu | H01R 12/7088 |

FOREIGN PATENT DOCUMENTS

| | | | |
|---|---|---|---|
| CN | 204538336 | U | 8/2015 |
| CN | 105006668 | A | 10/2015 |
| CN | 204905502 | U | 12/2015 |
| CN | 204966736 | U | 1/2016 |
| CN | 205282692 | U | 6/2016 |
| CN | 106025616 | A | 10/2016 |
| CN | 106252924 | A | 12/2016 |
| JP | H10294024 | A | 11/1998 |
| JP | 2001210434 | A | 8/2001 |
| JP | 2008066033 | A | 3/2008 |
| JP | 2014049411 | A | 3/2014 |
| WO | 2015113340 | A1 | 8/2015 |

OTHER PUBLICATIONS

English translation of the Written Opinion of the International Search Authority in the international application No. PCT/CN2017/080957, dated Jul. 24, 2017.

International Search Report in international application No. PCT/CN2017/080957, dated Jul. 24, 2017.

Written Opinion of the International Search Authority in international application No. PCT/CN2017/080957, dated Jul. 24, 2017.

Second Decision of Refusal of the Korean application No. 10-2019-7002373, dated Dec. 23, 2020.

Decision of Refusal of the Japanese application No. 2019-504011, dated Jan. 5, 2021.

Second Office Action of the Japanese application No. 2019-504011, dated Aug. 25, 2020.

Notice of Rejection of the Korean application No. 10-2019-7002373, dated Oct. 29, 2020.

First Office Action of the Japanese application No. 2019-504011, dated Mar. 27, 2020.

First Office Action of the Korean application No. 10-2019-7002373, dated Mar. 27, 2020.

First Office Action of the European application No. 17833252.4, dated May 13, 2020.

* cited by examiner

POWER INTERFACE, MOBILE TERMINAL AND POWER ADAPTER

TECHNICAL FIELD

The disclosure relates to the technical field of communication, and particularly, to a power interface, a mobile terminal and a power adapter.

BACKGROUND

With the advancement of technology, the Internet and mobile communication networks have provided massive function applications. A user may use a mobile terminal for a conventional application, for example, using a smart phone to answer the phone or make calls. Meanwhile, the user may also use a mobile terminal for browsing web, transmitting picture, playing game and the like.

When a mobile terminal is used for handling tasks, power of a battery may be greatly consumed due to an increased using frequency of the mobile terminal, and thus the mobile terminal is required to be charged frequently. Due to acceleration of the pace of life, particularly increasing emergencies, a user also expects to charge a battery of a mobile terminal with a high current.

SUMMARY

The disclosure is intended to at least partially overcomes or alleviates solve one of the technical problems in a related art. To this end, the disclosure discloses a power interface which has advantages of reliable connection and rapid charging.

The disclosure also discloses a mobile terminal, which is provided with the abovementioned power interface.

The disclosure also discloses a power adapter, which includes the abovementioned power interface.

The power interface according to embodiments of the disclosure includes: a body portion adapted to be connected with a circuit board, multiple data pins spaced from one another, multiple power pins spaced from one another and an insulating spacer layer. The data pins are connected with the body portion. The power pins are connected with the body portion and are spaced from the data pins. At least one of the multiple power pins includes a widened section. A cross-sectional area of the widened section is larger than a cross-sectional area of the data pin to increase a current load capacity of the power pin. At least one sunken portion is provided on the widened section at a position adjacent a front end of the power pin. A rough portion is arranged on an inner wall surface of the sunken portion. The insulating spacer layer is laid in the sunken portion.

According to the power interface of the embodiments of the disclosure, the widened portion is arranged on the power pin and then the current load capacity of the power pin may be increased, so that a current transmission speed may be increased. Thus, the power interface is endowed with a rapid charging function, and charging efficiency of a battery is improved. In addition, the sunken portion is provided in the widened section and the rough portion is arranged in the sunken portion, so that a contact area between the insulating spacer layer and the sunken portion may be enlarged, and thus the insulating spacer layer may further be stably attached to the interior of the sunken portion.

The mobile terminal according to the embodiments of the disclosure includes the abovementioned power interface.

According to the mobile terminal of the embodiments of the disclosure, the widened portion is arranged on the power pin and then the current load capacity of the power pin may be increased, so that the current transmission speed may be increased. Thus, the power interface is endowed with the rapid charging function, and the charging efficiency for the battery is improved.

The power adapter according to the embodiments of the disclosure is provided with the abovementioned power interface.

According to the power adapter of the embodiments of the disclosure, the widened portion is arranged on the power pin and then the current load capacity of the power pin may be increased, so that the current transmission speed may be increased. Thus, the power interface is endowed with the rapid charging function and the charging efficiency for the battery is improved.

LIST OF REFERENCE SYMBOLS

Figure 1:
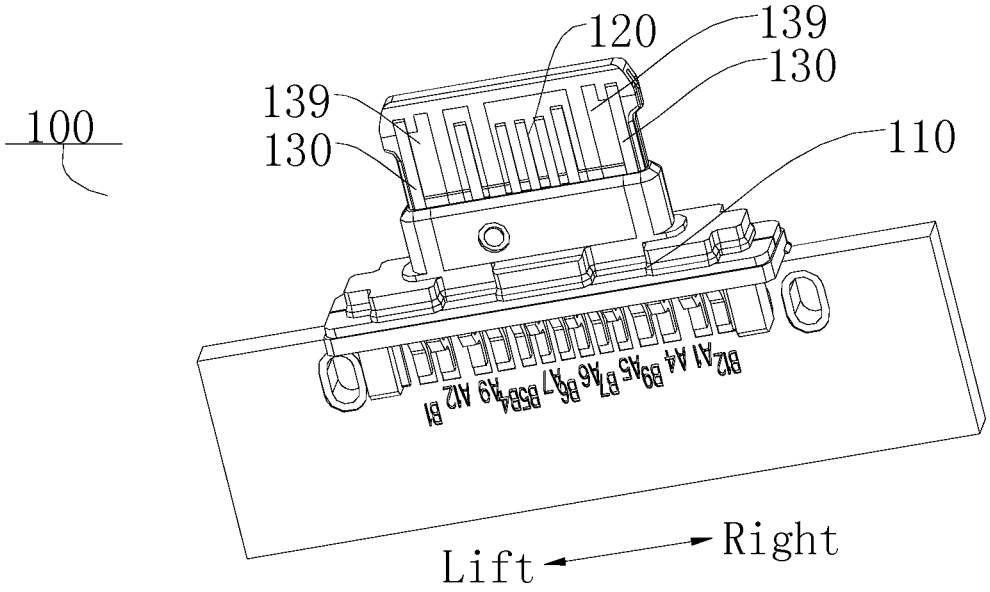
FIG. 1 illustrates a partial structure view of a power interface according to an embodiment of the disclosure.

100 power interface,
110 body portion,
120 data pin,
130 power pin, 131 front end, 132 widened section, 133 sunken portion, 134 first sidewall, 135 second sidewall, 136 first wall surface, 138 second wall surface, 138 chamfer, 139 insulating spacer layer,
140 rough portion, 150 middle patch

DETAILED DESCRIPTION

The embodiments of the disclosure will be described below in detail and examples of the embodiments are illustrated in the drawings. The embodiments described below with reference to the drawings are exemplary and intended to explain the disclosure and should not be understood as limits to the disclosure.

In the descriptions of the disclosure, it is to be understood that orientation or position relationships indicated by terms "length", "width", "thickness", "upper", "lower", "front", "back", "left", "right", "bottom", "inner", "outer", "circumferential" and the like are orientation or position relationships illustrated in the drawings, are adopted not to indicate or imply that indicated devices or components must be in specific orientations or structured and operated in specific orientations but only to conveniently describe the disclosure and simplify descriptions and thus should not be understood as limits to the disclosure.

In addition, terms "first" and "second" are only adopted for description and should not be understood to indicate or imply relative importance or implicitly indicate the number of indicated technical features. Therefore, a feature defined by "first" and "second" may explicitly or implicitly indicates inclusion of at least one such feature. In the descriptions of the disclosure, "multiple" means at least two, for example, two and three, unless otherwise limited definitely and specifically.

In the disclosure, unless otherwise definitely specified and limited, terms "mount", "mutually connect", "connect", "fix" and the like should be broadly understood. For example, the terms may refer to fixed connection and may also refer to detachable connection or integration. The terms may refer to mechanical connection and may also refer to electrical connection or mutual communication. The terms may refer to direct mutual connection, may also refer to indirect connection through a medium and may refer to communication in two components or an interaction relationship of the two components, unless otherwise definitely limited. For those of ordinary skill in the art, specific meanings of these terms in the disclosure can be understood according to a specific condition.

A power interface according to the embodiments of the disclosure will be described below with reference to FIG. 1-FIG. 10 in detail. It is to be noted that the power interface may be an interface for charging or data transmission and may be provided in a mobile phone, a tablet computer, a notebook computer or another rechargeable mobile terminal. The power interface may be electrically connected with a corresponding a power adapter to implement a communication connection of an electrical signal and a data signal.

As illustrated in FIG. 1-FIG. 10, the power interface 100 according to the embodiments of the disclosure includes a body portion 110, data pins 120, power pins 130 and an insulating spacer layer 139.

Specifically, the body portion 110 is adapted to be connected with a circuit board, and there are multiple data pins 120 which are spaced from one another and are connected with the body portion 110. There may be multiple power pins 130 which are spaced from one another and are connected with the body portion 110. The power pins 130 and the data pins 120 are arranged at intervals. At least one of the multiple power pins 130 includes a widened section 132 and a cross-sectional area of the widened section 132 is larger than a cross-sectional area of the data pin 120 to increase a current load capacity of the power pin 130.

It is to be noted that the power interface 100 may be formed in a mobile terminal, a battery may be arranged in the mobile terminal (for example, a mobile phone, a tablet computer and a notebook computer) and an external power supply may charge the battery through the power interface 100. During rapid charging of the power interface 100, the power pin 130 with the widened section 132 may be configured to be loaded with a relatively high charging current. During normal charging of the power interface 100, at least one sunken portion 133 in the widened section 132 may avoid the contact of power pin 130 with a corresponding pin on a power adapter. Therefore, the power interface 100 in the embodiments may be applied to different power adapters. For example, during rapid charging of the power interface 100, the power interface 100 may be electrically connected with a corresponding power adapter with a rapid charging function; and during normal charging of the power interface 100, the power interface 100 may be electrically connected with a corresponding ordinary power adapter. It is to be noted herein that rapid charging may refer to a charging state in which a charging current is more than or equal to 2.5 A, or refer to a charging state in which rated output power is not lower than 15 W. The normal charging may refer to a charging state in which the charging current is lower than 2.5 A, or refer to a charging state in which the rated output power is lower than 15 W.

For improving stability of the power interface 100 in use, an interior of the sunken portion 133 may be filled with the insulating spacer layer 139. In such a manner, during normal charging of the power interface 100, the insulating spacer layer 139 may effectively space the power pin 130 from the corresponding pin on the power adapter, so as to protect the pin on the power adapter from a charging interference generated by the widened section 132, thereby improving adaptability of the power interface 100 to the ordinary charging power adapter and improving stability of the power interface 100 in a normal charging state. The insulating spacer layer 139 may be made from a thermal conductive insulating material.

Figure 7:
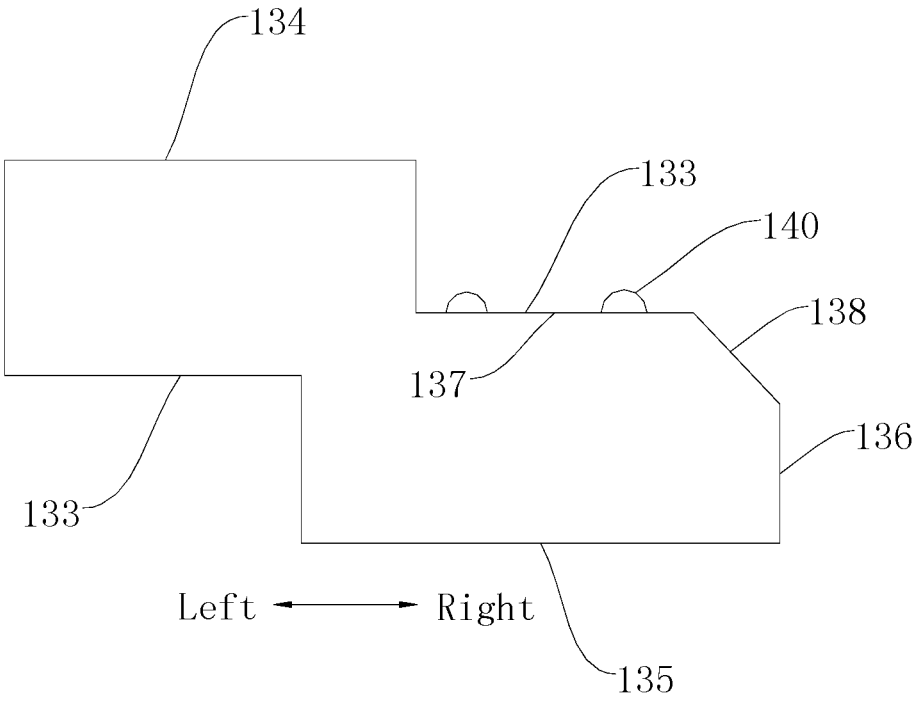
FIG. 7 illustrates a structure view of a power pin of a power interface according to an embodiment of the disclosure.
Figure 8:
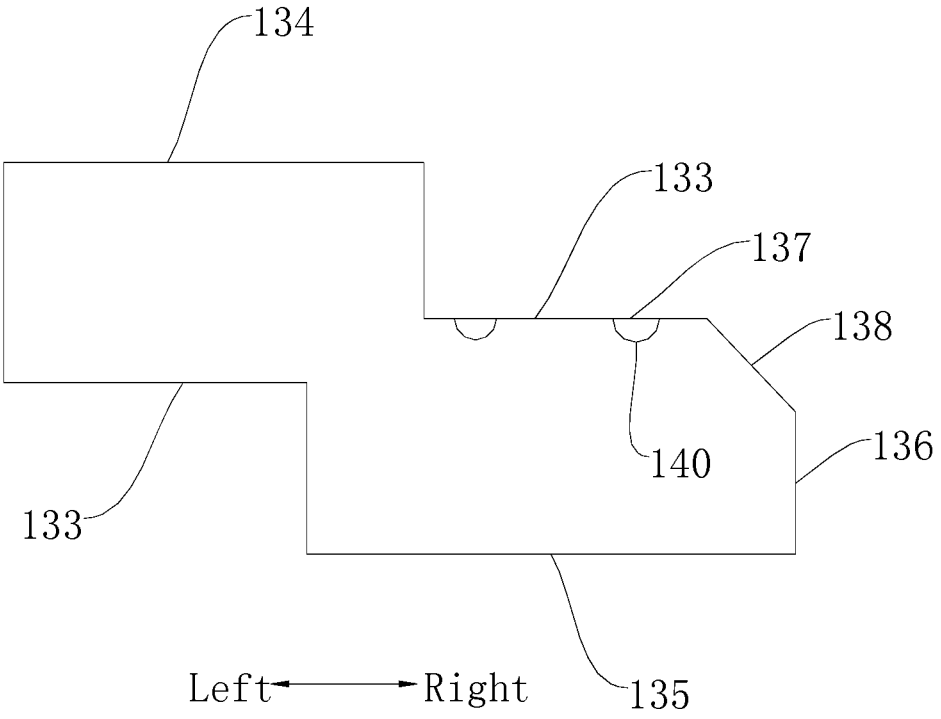
FIG. 8 illustrates a structure view of a power pin of a power interface according to an embodiment of the disclosure.

As illustrated in FIG. 7 and FIG. 8, for improving attach-ability of the insulating spacer layer 139 in the sunken portion 133, a rough portion 140 may be arranged on an inner wall surface of the sunken portion 133. In such a manner, a contact area between the insulating spacer layer 139 and the sunken portion 133 may be enlarged, thereby stably attaching the insulating spacer layer 139 to the interior of the sunken portion 133.

According to the power interface 100 of the embodiments of the disclosure, the widened portion 132 is arranged on the power pin 130 and then the current load capacity of the power pin 130 may be increased, so that a current transmission speed may be increased. Thus, the power interface 100 is endowed with a rapid charging function, and charging efficiency for the battery is improved. In addition, the sunken portion 133 is formed in the widened section 132 and the rough portion 140 is arranged in the sunken portion 133, so that the contact area between the insulating spacer layer 139 and the sunken portion 133 may be enlarged, and thus the insulating spacer layer 139 may further be stably attached to the interior of the sunken portion 133.

In some examples of the disclosure, as illustrated in FIG. 7, the rough portion 140 may be formed into protrusions. The protrusions in the sunken portion 133 may be embedded into the insulating spacer layer 139, thereby firmly attaching the insulating spacer layer 139 to the interior of the sunken portion 133. In some other embodiments of the disclosure, as illustrated in FIG. 8, the rough portion 140 may be formed into grooves and an interior of the grooves may be filled with the insulating spacer layer 139. In some embodiments of the disclosure, the rough portion 140 may also be formed into a rough surface.

According to an embodiment of the disclosure, the cross-sectional area of the widened section 132 is S, $S \geq 0.09805$ $mm^2$. Experiments show that, when $S \geq 0.09805$ $mm^2$, the current load capacity of the power pin 130 is at least 10 A and thus the current load capacity of the power pin 130 may be increased to improve the charging efficiency. Further tests show that, when S=0.13125 $mm^2$, the current load capacity of the power pin 130 is 12A or more and thus the charging efficiency may be improved.

According to an embodiment of the disclosure, a thickness of the power pin 130 is D, and D meets the following requirement: 0.1 mm≤D≤0.3 mm. Experiments show that, when 0.1 mm≤D≤0.3 mm, the current load capacity of the power pin 130 is at least 10 A and thus the current load capacity of the power pin 130 may be increased to improve the charging efficiency. Further tests show that, when D=0.25 mm, the current load capacity of the power pin 130 may be greatly increased, the current load capacity of the power pin 130 is 12 A or more, and thus the charging efficiency may be improved.

Figure 6:
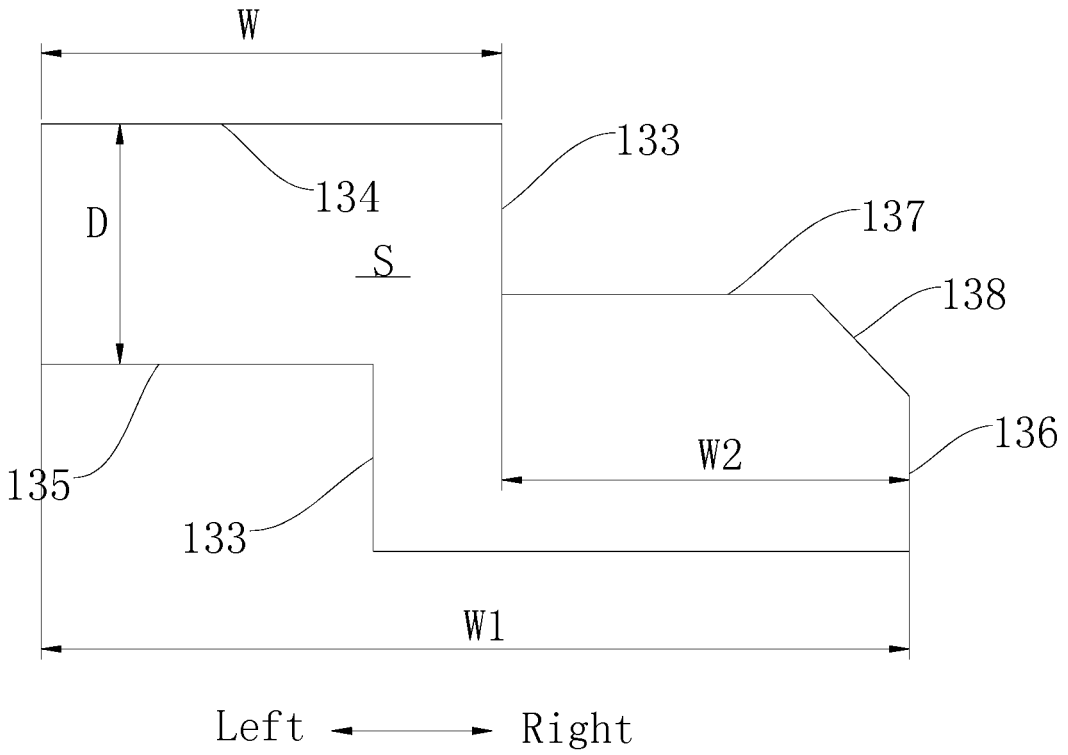
FIG. 6 illustrates a structure view of a power pin of a power interface according to an embodiment of the disclosure.
Figure 10:
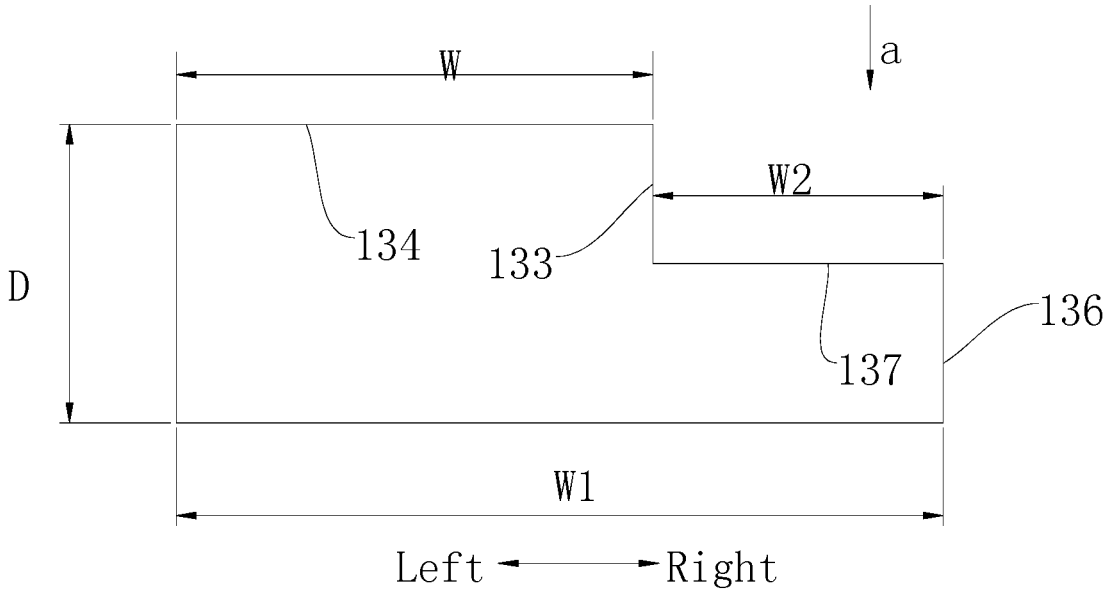
FIG. 10 illustrates a structure view of a power pin of a power interface according to an embodiment of the disclosure.

According to an embodiment of the disclosure, as illustrated in FIG. 6 and FIG. 10, a width of the widened section 132 is W1, a width of the sunken portion 133 on the widened section 132 is W2, and W1 and W2 meet the following requirement: 0.24 mm≤W1-W2≤0.32 mm. Experiments show that, when 0.24 mm≤W1-W2 ≤0.32 mm, the current load capacity of the power pin 130 is at least 10 A and thus the current load capacity of the power pin 130 may be increased to improve the charging efficiency. Further tests show that, when W1-W2=0.25 mm, the current load capacity of the power pin 130 may be greatly increased, the current load capacity of the power pin 130 is 12 A or more, and thus the charging efficiency may be improved.

For example, as illustrated in FIG. 6 and FIG. 10, the power pin 130 is provided with a first sidewall 134. The sunken portion 133 is arranged at a position close to a right side (the right side illustrated in FIG. 6 and FIG. 10) of the first sidewall 134. The part on the first sidewall 134 other than the sunken portion 133 is formed as a contact surface. The contact surface is adapted to be electrically connected with the power adapter. A width of the contact surface in a width direction (a left-right direction illustrated in FIG. 6 and FIG. 10) of the widened section 132 is W. The width of the widened section 132 is W1 and the width of the sunken portion 133 is W2. In this case, W=W1-W2, and W meets the following requirement: 0.24 mm≤W≤0.32 mm. Experiments show that, when 0.24 mm≤W≤0.32 mm, the current load capacity of the power pin 130 is at least 10 A and thus the current load capacity of the power pin 130 may be increased to improve the charging efficiency. Further tests show that, when W=0.25 mm, the current load capacity of the power pin 130 may be greatly increased, the current load capacity of the power pin 130 is 12 A or more, and thus the charging efficiency may be improved.

Figure 2:
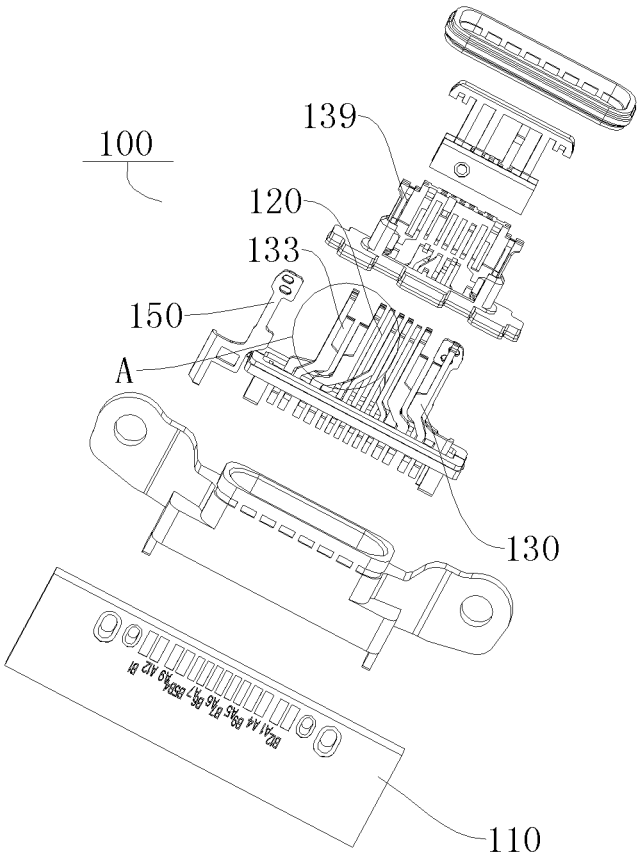
FIG. 2 illustrates an exploded view of a power interface according to an embodiment of the disclosure.

According to an embodiment of the disclosure, as illustrated in FIG. 2, the widened section 132 may be positioned at a middle part of the power pin 130. In such a manner, a layout of the multiple power pins 130 and the multiple data pins 120 may be optimized and a space of the power interface 100 may be fully utilized, so that structural compactness and reasonability of the power interface 100 may be improved.

According to some embodiments of the disclosure, the sunken portion 133 extends throughout a sidewall of at least one side of the widened section 132. On one hand, the power interface 100 may be applied to power adapters of different types. On the other hand, machining is facilitated and thus a machining process may be simplified. Furthermore, the sidewall, throughout which the sunken portion 133 extends, of the widened section 132 is a first wall surface 136. A wall surface of the sunken portion 133, which extends throughout the widened section 132, is a second wall surface. A chamfer 138 is formed at a position where the first wall surface 136 is intersected with the second wall surface 137. It is to be noted that formation of the chamfer 138 may not only enlarge the contact area between the sunken portion 133 and the insulating spacer layer 139 and improve the attachability of the insulating spacer layer 139 in the sunken portion 133, but also ensure a smooth transition of an outer surface of the power pin 130. In addition, when a stamping process is required for machining of the power pin 130, the part where the chamfer 138 is located may also be arranged to accommodate leftovers produced in a stamping process, so that smoothness of the outer surface of the power pin 130 may be improved.

According to some embodiments of the disclosure, as illustrated in FIG. 10, there is one sunken portion 133. The sunken portion 133 is positioned on the first sidewall 134 of the widened section 132 and the first sidewall 134 is adapted to be electrically connected with a conductive member. It is to be noted that, when the power interface 100 is electrically connected with the power adapter, the corresponding pin in the power adapter act as the conductive member and electrically connected with the first sidewall 134 of the power pin 130. It can be understood that, when the power interface 100 is electrically connected with the power adapter, the corresponding pin in the power adapter is closely attached to the first sidewall 134 of the power pin 130, thereby implementing a stable electrical connection between the power interface 100 and the power adapter.

According to some other embodiments of the disclosure, there are two sunken portions. Each of the two sunken portions 133 is positioned on a respective one of the first sidewall 134 and second sidewall 135 of the widened section 132. The first sidewall 134 is adapted to be electrically connected with the conductive member. The second sidewall 135 is opposite to the first sidewall 134, and the two sunken portions 133 are spaced apart in the width direction of the widened section 132. For example, as illustrated in FIG. 4-FIG. 8, the width direction of the widened section 132 may be the left-right direction illustrated in FIG. 4-FIG. 8. The first sidewall 134 faces an outer side (an outward direction illustrated in FIG. 4) of the power interface 100. The second sidewall 135 faces an inner side (an inward direction illustrated in FIG. 4) of the power interface 100. The two sunken portions 133 are spaced apart in the left-right direction. One sunken portion 133 is positioned on the first sidewall 134, and the other sunken portion 133 is positioned on the second sidewall 135.

Figure 9:
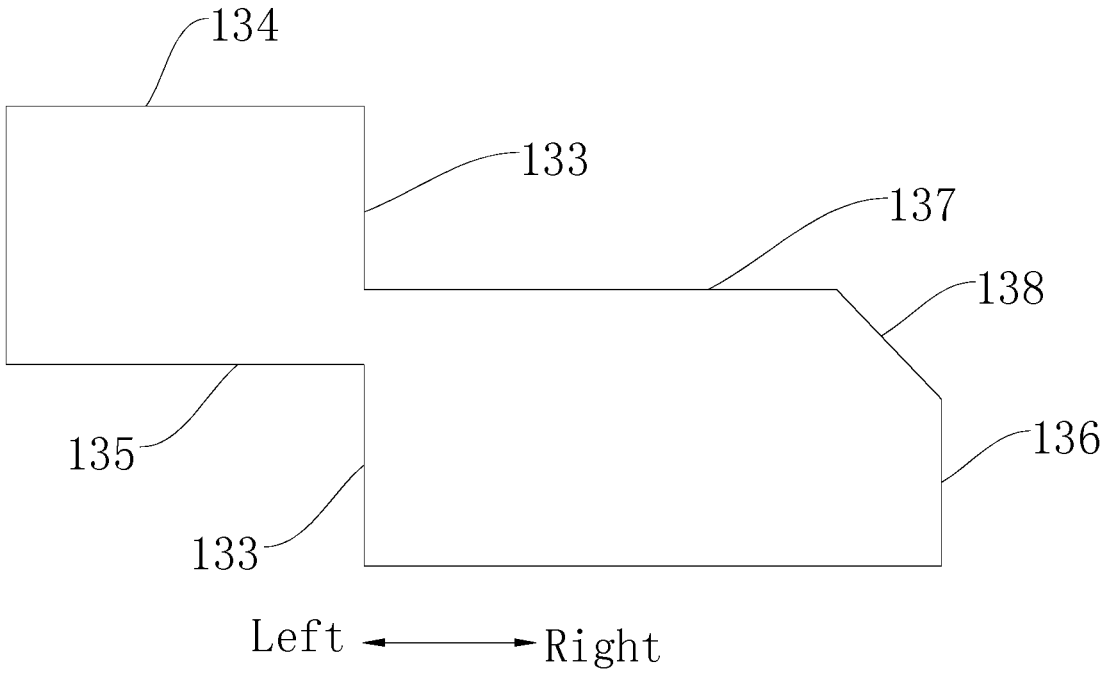
FIG. 9 illustrates a structure view of a power pin of a power interface according to an embodiment of the disclosure.

In some examples of the disclosure, as illustrated in FIG. 9, the two sunken portions 133 are a first sunken portion 133*a* and a second sunken portion 133*b* respectively. A left sidewall of the first sunken portion 133*a* and a right sidewall of the second sunken portion 133*b* are positioned in the same plane. Therefore, the sunken portion 133 may be conveniently machined. It is to be noted that the sunken portion 133 may be formed by stamping. For example, the first sunken portion 133*a* and the second sunken portion 133*b* may be formed by stamping at two times. Specifically, the first sidewall 134 is stamped for the first time to form the first sunken portion 133*a* at first, and then the second sidewall 135 is stamped for the second time to form the second sunken portion 133*b*. For another example, the first sunken portion 133*a* and the second sunken portion 133*b* may be formed by stamping at one time. Specifically, a bump adapted to the sunken portion is arranged on a stationary die, thereby simultaneously forming the first sunken portion 133*a* and the second sunken portion 133*b* in the stamping process.

The power interface 100 according to the embodiments of the disclosure will be described below with reference to FIG. 1-FIG. 10 in detail. It is to be understood that the following descriptions are not specific limits to the disclosure but only exemplary descriptions.

For ease of the description, the power interface 100 described as a Type-C interface, for example. A Type-C interface is an abbreviation of a Universal Serial Bus (USB) Type-C interface. It is an interface form and is a totally new data, video, audio, electrical energy transmission interface specification drafted by the USB standardization organization to overcome the longstanding shortcomings of USB interfaces that physical interface specifications are not unified, electrical energy may be unidirectionally transmitted only and the like.

A characteristic of the Type-C is that a device may claim its intention for occupying a VBUS (i.e., a positive connecting line of a conventional USB) to another connected party through a CC pin in an interface specification, the party with a relatively strong intention finally outputs a voltage and a current to the VBUS and the other party accepts power supplied by the VBUS or still refuses the supplied power but without influence on a transmission function. For more conveniently using this bus definition, a Type-C interface chip (for example, LDR6013) usually divides devices into four roles: a Downstream Facing Port (DFP), a strong Dual Role Port (DRP), a DRP and an Upstream Facing Port (UFP). Intentions of the four roles for occupying the VBUS are progressively weakened in sequence.

Herein, the DFP is equivalent to an adapter and may keep intended to output a voltage to the VBUS. The strong DRP is equivalent to a mobile power supply and may stop output to the VBUS only when there is an adapter. The DRP is equivalent to a mobile terminal, expects to be powered by an opposite party under a normal condition and, when there is a device weaker than itself, reluctantly outputs a voltage to the opposite party. The UFP never externally outputs electrical energy and is usually a weak-battery device or battery-free device, for example, a Bluetooth headset. The USB Type-C supports normal and reverse plugging. Since there are totally four groups of power supplies and Grounds (GND) on front and reverse surfaces, supported power may be greatly improved.

The power interface 100 in the embodiments may be a USB Type-C interface, may be applied to a power adapter with a rapid charging function and is also applied to an ordinary power adapter. It is to be noted herein that rapid charging refers to a charging state in which a charging current is higher than 2.5 A, and normal charging may refer to a charging state in which the charging current is less than or equal to 2.5 A. That is, when the power adapter with the rapid charging function is adopted to charge the power interface 100, the charging current is more than or equal to 2.5 A or rated output power is not lower than 15 W and, when the ordinary power adapter is adopted to charge the power interface 100, the charging current is lower than 2.5 A or the rated output power is lower than 15 W.

For standardizing the power interface 100 and the power adapter adapted to the power interface 100, a size of the power interface 100 meets a design requirement of a standard interface. For example, if a width (a width in a left-right direction of the power interface 100, the left-right direction illustrated in FIG. 1) consistent with a design requirement of a power interface 100 with 24 pins is a, a width (a width in the left-right direction of the power interface 100, the left-right direction illustrated in FIG. 1) of the power interface 100 in the embodiments is also a, for making the power interface 100 in the embodiments meet a design standard. For enabling power pins 130 to load relatively high charging currents in a limited space, some of pins among the 24 pins may be removed and, meanwhile, cross-sectional areas of the power pins 130 are enlarged to load the relatively high charging currents to easily realize the rapid charging function. Enlarged parts of the power pins 130 may be arranged at positions of the removed pins, by which, on one hand, an optimal layout of parts of the power interface 100 is implemented and, on the other hand, a current loading capability of the power pins 130 is improved.

Figure 3:
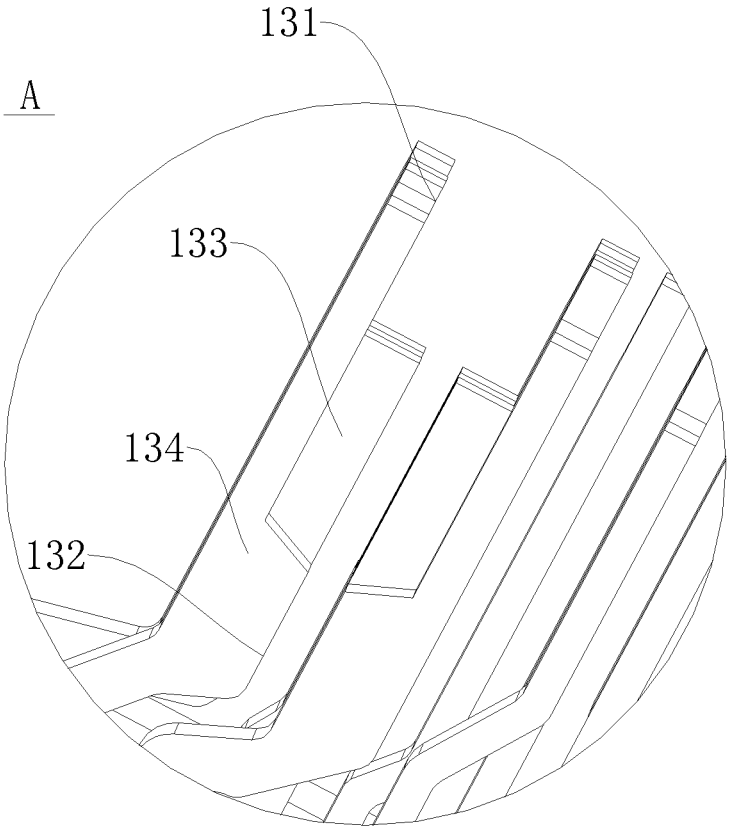
FIG. 3 illustrates a partial enlarged schematic view of part A in FIG. 2.

Specifically, as illustrated in FIG. 1-FIG. 3, the power interface 130 includes a body portion 110, six data pins 120 and eight power pins 130. The six data pins 120 are A5, A6, A7, B5, B6 and B7 respectively, the eight power pins 130 are A1, A4, A9, A12, B1, B4, B9 and B12 respectively and the eight power pins 130 include four VBUS pins and four GND pins. A middle patch 150 is sandwiched by two opposite GND pins. It is to be noted that the power interface 100 may be formed in a mobile terminal, a battery may be arranged in the mobile terminal (for example, a mobile phone, a tablet computer and a notebook computer) and an external power supply may be connected with the power interface 100 through a power adapter to further charge the battery.

The body portion 110 is adapted to be connected with a circuit board and there are multiple data pins 120 which are spaced from one another and are connected with the body portion 110. There may be multiple power pins 130 which are spaced from one another and are connected with the body portion 110. The power pins 130 and the data pins 120 are arranged at intervals. At least one of the multiple power pins 130 includes a widened section 132, the widened section 132 is positioned at a middle part of the power pin 130 and a cross-sectional area of the widened section 132 is larger than a cross-sectional area of the data pin 120 to increase a current load capacity of the power pin 130. The widened section 132 may occupy a position of a removed pin, which, on one hand, may increase a charging current loadable for the power pin 130 and, on the other hand, may increase a space utilization rate of the power interface 100.

As illustrated in FIG. 6 and FIG. 10, the current load capacity of the power pin 130 is at least 12 A and thus charging efficiency may be improved. Furthermore, as illustrated in FIG. 10, when W=0.25 mm, the current load capacity of the power pin 130 may be 14A or more and thus the charging efficiency may be improved.

As illustrated in FIG. 6 and FIG. 10, the power pin 130 is provided with a first sidewall 134. A sunken portion 133 is formed at a position close to a right side (the right side illustrated in FIG. 6 and FIG. 10) of the first sidewall 134. The part on the first sidewall 134 other than the sunken portion 133 is formed as a contact surface. The contact surface is adapted to be electrically connected with the power adapter. A width of the contact surface in a width direction (a left-right direction illustrated in FIG. 6 and FIG. 10) of the widened section 132 is W, a width of the widened section 132 is W1 and a width of the sunken portion 133 is W2. In this case, W=W1-W2. Tests show that, when W=0.25 mm, the current load capacity of the power pin 130 may be greatly improved and the current load capacity of the power pin 130 may be 10 A, 12 A, 14 A or more, so that the charging efficiency may be improved.

As illustrated in FIG. 4-FIG. 8, a part of an outer surface of each power pin 130 and an outer surface of each data pin 120 are wrapped with a coating portion made from a thermal conductive insulating material. The sunken portion 133 is formed on the widened section 132 at a position close to a front end 131 of the power pin 130. An interior of the sunken portion 133 may be filled with the coating portion. A rough surface may be arranged on an inner wall surface of the sunken portion 133 and then a contact area between the coating portion and the sunken portion 133 may be enlarged, so that the coating portion may be stably attached to the interior of the sunken portion 133.

It is to be noted that, during rapid charging of the power interface 100, the power pin 130 with the widened section 132 may be configured to be loaded with a relatively high charging current and, during normal charging of the power interface 100, the coating portion filling the sunken portion 133 may avoid the contact of the power pin 130 with a corresponding pin on the power adapter. Therefore, the power interface 100 in the embodiments may be applied to different power adapters.

Figure 4:
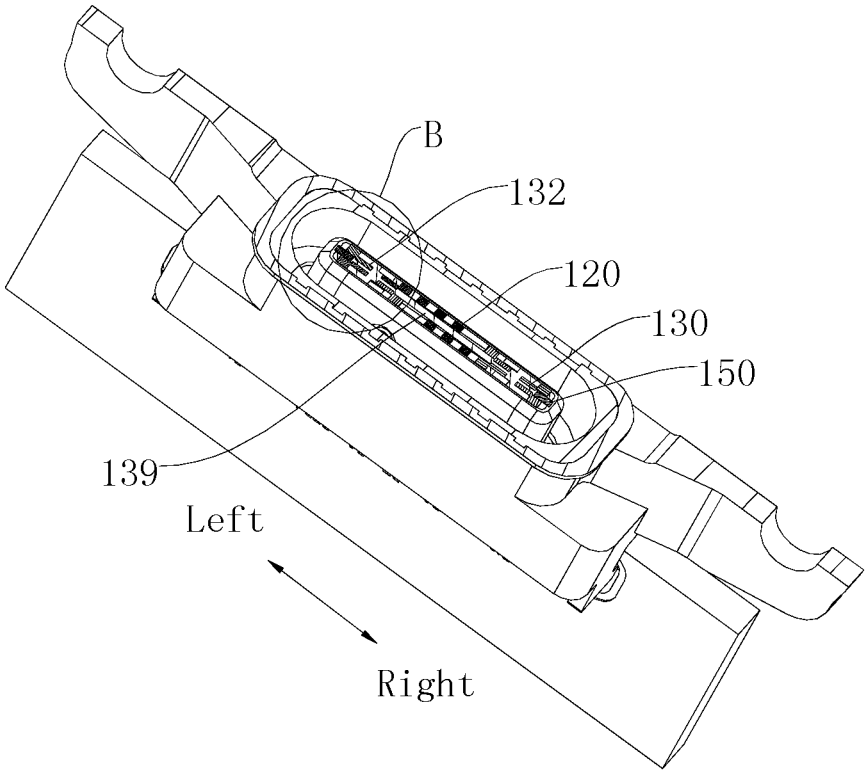
FIG. 4 illustrates a sectional view of a power interface according to an embodiment of the disclosure.
Figure 5:
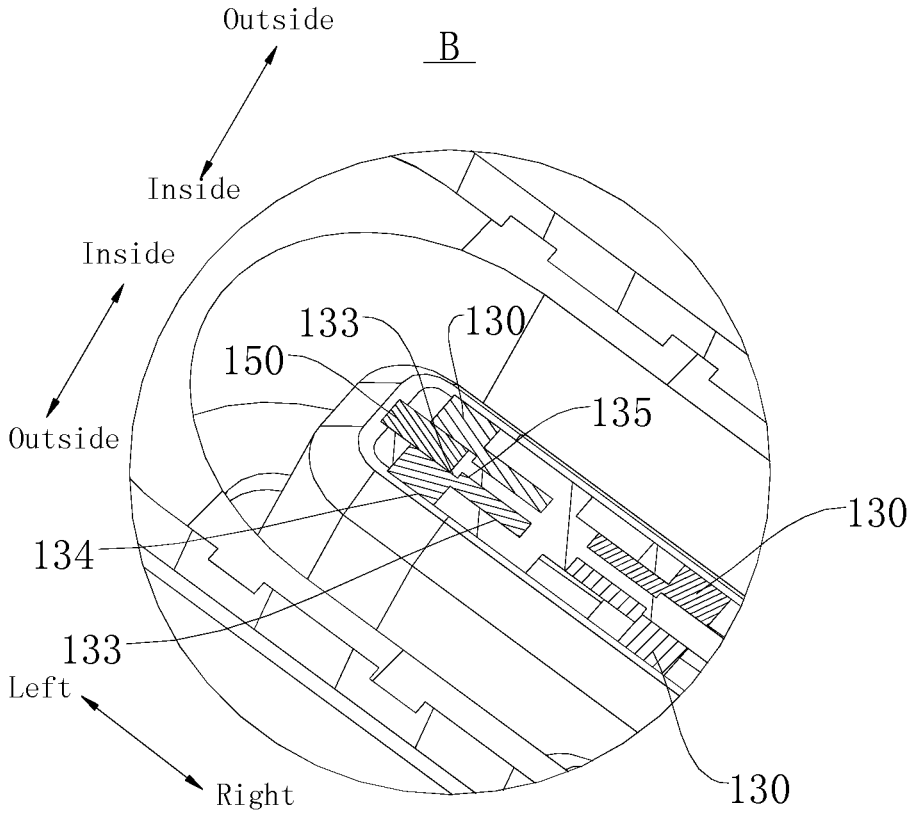
FIG. 5 illustrates a partial enlarged schematic view of part B in FIG. 4.

As illustrated in FIG. 6, there may be two sunken portions 133, and the two sunken portions 133 are spaced apart in the left-right direction (the left-right direction illustrated in FIG. 4-FIG. 8). As illustrated in FIG. 4 and FIG. 5, a second sidewall 135 is opposite to the first sidewall 134, the first sidewall 134 is adapted to be electrically connected with a conductive member and faces an outer side (an outward direction illustrated in FIG. 4) of the power interface 100, the second sidewall 135 is opposite to the first sidewall 134 and faces an inner side (an inward direction illustrated in FIG. 4) of the power interface 100, one sunken portion 133 is positioned on the first sidewall 134 and the other sunken portion 133 is positioned on the second sidewall 135.

As illustrated in FIG. 6, the sunken portion 133 extends throughout a sidewall of at least one side of the widened section 132. On one hand, the power interface 100 may be applied to power adapters of different types. On the other hand, machining is facilitated and thus a machining process may be simplified. Furthermore, the sidewall of the widened section 132, throughout which the sunken portion 133 extends, is a first wall surface 136. A wall surface of the sunken portion 133, which extends throughout the widened section 132, is a second wall surface. A chamfer 138 is formed at a position where the first wall surface 136 is intersected with the second wall surface 137. It is to be noted that formation of the chamfer 138 may not only enlarge the contact area between the sunken portion 133 and the insulating spacer layer 139 and improve the attachability of the insulating spacer layer 139 in the sunken portion 133 but also ensure a smooth transition of an outer surface of the power pin 130. In addition, when a stamping process is required for machining of the power pin 130, the part with the chamfer 138 may also be arranged to accommodate leftovers produced in a stamping process, so that smoothness of the outer surface of the power pin 130 may be improved.

In such a manner, the widened portion 132 is arranged on the power pin 130 and then the current load capacity of the power pin 130 may be increased, so that a current transmission speed may be increased, the power interface 100 is endowed with the rapid charging function and the charging efficiency for the battery is improved.

A mobile terminal according to the embodiments of the disclosure includes the abovementioned power interface 100. The mobile terminal may implement transmission of an electrical signal and a data signal through the power interface 100. For example, the mobile terminal may be electrically connected with a power adapter through the power interface 100 to realize a charging or data transmission function.

According to the mobile terminal of the embodiments of the disclosure, a widened portion 132 is arranged on a power pin 130 and then a current load capacity of the power pin 130 may be increased, so that a current transmission speed may be increased, the power interface 100 is endowed with a rapid charging function and charging efficiency of a battery is improved.

A power adapter according to the embodiments of the disclosure is provided with the abovementioned power interface. A mobile terminal may implement transmission of an electrical signal and a data signal through the power interface 100.

According to the power adapter of the embodiments of the disclosure, a widened portion 132 is arranged on a power pin 130 and then a current load capacity of the power pin 130 may be increased, so that a current transmission speed may be increased, the power interface 100 is endowed with a rapid charging function and charging efficiency of a battery is improved.

In the descriptions of the specification, the descriptions made with reference to terms "an embodiment", "some embodiments", "example", "specific example", "some examples" or the like refer to that specific features, structures, materials or characteristics described in combination with the embodiment or the example are included in at least one embodiment or example of the disclosure. In the specification, these terms are not always schematically expressed for the same embodiment or example. Moreover, the specific described features, structures, materials or characteristics may be combined in a proper manner in any one or more embodiments or examples. In addition, those skilled in the art may integrate and combine different embodiments or examples described in the specification and features of different embodiments or examples without conflicts.

The embodiments of the disclosure have been illustrated or described above. However, it can be understood that the abovementioned embodiments are exemplary and should not be understood as limits to the disclosure and those of ordinary skill in the art may make variations, modifications, replacements, transformations to the abovementioned embodiments within the scope of the disclosure.

The invention claimed is:

1. A power interface, comprising:

a body portion adapted to be connected with a circuit board;

multiple data pins spaced from one another, the data pins being connected with the body portion;

multiple power pins spaced from one another, the power pins being connected with the body portion, the power pins being spaced from the data pins, at least one of the multiple power pins comprising a widened section, a cross-sectional area of the widened section being larger than a cross-sectional area of each of the multiple data pins to increase a current load capacity of the power pin, at least one sunken portion being provided on the widened section at a position close to a front end of the power pin, a rough portion being arranged on an inner wall surface of the sunken portion; and an insulating spacer layer, the insulating spacer layer being laid in the sunken portion.

2. The power interface of claim 1, wherein the cross-sectional area of the widened section is S, $S \geq 0.09805\ mm^2$.

3. The power interface of claim 2, wherein $S=0.13125\ mm^2$.

4. The power interface of claim 1, wherein a thickness of the power pin is D, and D meets the following requirement: $0.1\ mm \leq D \geq 0.3\ mm$.

5. The power interface of claim 4, wherein D=0.25 mm.

6. The power interface of claim 1, wherein a width of the widened section is W1, a width of the sunken portion in the widened section is W2, and W1 and W2 meet the following requirement: 0.24 mm≥W1-W2≥0.32 mm.

7. The power interface of claim 6, wherein W1-W2=0.25 mm.

8. The power interface of claim 1, wherein there is one sunken portion, the one sunken portion being positioned on a first sidewall of the widened section, the first sidewall being adapted to be electrically connected with a conductive member.

9. The power interface of claim 1, wherein there are two sunken portions, each of the two sunken portions being positioned on a respective one of a first sidewall and a second sidewall of the widened section, the first sidewall being adapted to be electrically connected with a conductive member, the second sidewall being arranged opposite to the first sidewall, and the two sunken portions being spaced apart in a width direction of the widened section.

10. The power interface of claim 1, wherein the sunken portion extends throughout the sidewall on at least one side of the widened section.

11. The power interface of claim 10, wherein the sidewall of the widened section, throughout which the sunken portion extends, is a first wall surface, a wall surface of the sunken portion, which extends throughout the widened section, is a second wall surface, and a chamfer is provided at a position where the first wall surface is intersected with the second wall surface.

12. The power interface of claim 1, wherein an interior of the sunken portion is filled with the insulating spacer layer.

13. The power interface of claim 1, wherein the rough portion is formed into protrusions or grooves.

14. The power interface of claim 1, wherein the rough portion is formed into a rough surface.

15. The power interface of claim 1, wherein the widened section is positioned at a middle part of the power pin.

16. A mobile terminal, comprising a power interface, the power interface comprising:

a body portion adapted to be connected with a circuit board;

multiple data pins spaced from one another, the data pins being connected with the body portion;

multiple power pins spaced from one another, the power pins being connected with the body portion, the power pins being spaced from the data pins, at least one of the multiple power pins comprising a widened section, a cross-sectional area of the widened section being larger than a cross-sectional area of each of the multiple data pin to increase a current load capacity of the power pin, at least one sunken portion being provided on the widened section at a position close to a front end of the power pin; and an insulating spacer layer, the insulating spacer layer being laid in the sunken portion.

17. A power adapter, comprising a power interface, the power interface comprising:

a body portion adapted to be connected with a circuit board;

multiple data pins spaced from one another, the data pins being connected with the body portion;

multiple power pins spaced from one another, the power pins being connected with the body portion, the power pins being spaced from the data pins, at least one of the multiple power pins comprising a widened section, a cross-sectional area of the widened section being larger than a cross-sectional area of each of the multiple data pins to increase a current load capacity of the power pin, at least one sunken portion being provided on the widened section at a position close to a front end of the power pin; and an insulating spacer layer, the insulating spacer layer being laid in the sunken portion.

18. The power interface of claim 1, wherein the insulating spacer layer is made from a thermal conductive insulating material.

19. The mobile terminal of claim 16, wherein a part of an outer surface of each power pin and an outer surface of each data pin are wrapped with a coating portion made from a thermal conductive insulating material.

20. The power adapter of claim 17, wherein a part of an outer surface of each power pin and an outer surface of each data pin are wrapped with a coating portion made from a thermal conductive insulating material.

* * * * *